US008021289B2

(12) United States Patent
Vastola et al.

(10) Patent No.: US 8,021,289 B2
(45) Date of Patent: Sep. 20, 2011

(54) CLEAN-IN-PLACE DECANTER CENTRIFUGE

(75) Inventors: Michael L. Vastola, Hamilton, OH (US); Pawel K. Krawczyk, Cincinnati, OH (US); Michael T. Mullins, Villa Hills, KY (US)

(73) Assignee: TEMA Systems, Inc., Cincinnati, OH (US)

( * ) Notice: Subject to any disclaimer, the term of this patent is extended or adjusted under 35 U.S.C. 154(b) by 407 days.

(21) Appl. No.: 12/390,058

(22) Filed: Feb. 20, 2009

(65) Prior Publication Data

US 2010/0216623 A1 Aug. 26, 2010

(51) Int. Cl.
*B04B 1/20* (2006.01)
*B04B 15/06* (2006.01)

(52) U.S. Cl. ..... 494/29; 494/38; 494/53

(58) Field of Classification Search ..... 494/23–30, 494/38, 39, 41, 53, 54, 56, 60, 61; 210/380.1, 210/380.3

See application file for complete search history.

(56) References Cited

U.S. PATENT DOCUMENTS

| | | | | |
|---|---|---|---|---|
| 3,741,466 A | | 6/1973 | Weiland | |
| 3,802,621 A | * | 4/1974 | Merzenich | 494/29 |
| 3,960,318 A | * | 6/1976 | Dahlberg | 494/27 |
| 4,036,426 A | | 7/1977 | Little | |
| 4,120,447 A | * | 10/1978 | Jager | 494/14 |
| 4,416,655 A | | 11/1983 | Bennett | |
| 4,496,340 A | | 1/1985 | Redeker et al. | |
| 4,978,331 A | | 12/1990 | Luchetta et al. | |
| 5,151,079 A | * | 9/1992 | Flanigan et al. | 494/27 |
| 5,281,195 A | | 1/1994 | Swartzbaugh | |

(Continued)

FOREIGN PATENT DOCUMENTS

JP 2002018320 A * 1/2002

OTHER PUBLICATIONS

Siebtechnik Centrifuges for Chemicals & Minerals, TEMA, information booklet, WB173.11E/01.2007, pp. 1-32.

*Primary Examiner* — Charles E Cooley
(74) *Attorney, Agent, or Firm* — Hasse & Nesbitt LLC; Donald E. Hasse

(57) ABSTRACT

A clean-in-place decanter centrifuge for processing a combined liquid and solid material to separate the solid material from the liquid. The centrifuge is designed for use in the food processing industry, particularly for dairy products, and therefore has fluid injectors for cleaning all surfaces within the centrifuge including the opposed mating surfaces which function as non-contacting seal mechanisms. The centrifuge has no metal-to-metal contact areas within the interior of the bowl and scroll assembly. In one embodiment, the outer wall of the bowl and scroll assembly comprises a plurality of drain lines located in the rear wall section of the bowl to allow essentially all liquid to drain from the bowl and scroll assembly. In another embodiment, the bowl hub comprises at least one drain line to allow lubrication oil to drain into said cavity and prevent ingress of lubrication oil into said bowl and scroll assembly. In another embodiment, the discharge housing further comprises an enclosure bound by the interior surface of the exterior wall of the discharge housing, partitions within the discharge housing, and the outer wall of the rotating bowl, said partitions being separated from the outer wall of the rotating bowl by non-contacting seals whereby fine solid material that migrates into said enclosure is removable from the discharge housing by liquid sprayed from one or more fluid injectors inserted into said enclosure.

22 Claims, 8 Drawing Sheets

U.S. PATENT DOCUMENTS

| | | | | |
|---|---|---|---|---|
| 5,380,434 | A | 1/1995 | Paschedag | |
| 5,397,471 | A | 3/1995 | Rodebush et al. | |
| 6,193,643 | B1 | 2/2001 | Larsson | |
| 6,248,054 | B1 | 6/2001 | Berger et al. | |
| 6,475,131 | B1 | 11/2002 | Yoshida et al. | |
| 6,632,166 | B2 | 10/2003 | Carr | |
| 6,736,968 | B2 | 5/2004 | Mullins et al. | |
| 6,986,733 | B2 * | 1/2006 | Beyer et al. | 494/41 |
| 7,217,234 | B2 | 5/2007 | Zettier | |
| 2006/0287183 | A1 | 12/2006 | Astheimer et al. | |
| 2008/0053482 | A1 | 3/2008 | Astheimer et al. | |
| 2010/0216623 | A1 * | 8/2010 | Vastola et al. | 494/23 |

* cited by examiner

CLEAN-IN-PLACE DECANTER CENTRIFUGE

BRIEF DESCRIPTION OF THE INVENTION

The present invention relates to a clean-in-place decanter centrifuge. More particularly, the invention relates to a decanter centrifuge having self-cleaning components useful in the food and beverage industry, especially for dairy products.

BACKGROUND OF THE INVENTION

Various centrifuges have been used to separate a crystalline or granular material from a liquid carrying the crystalline or granular material. Such centrifuges are typically used in a continuous process in which the combined liquid and solid material is continuously fed into and discharged from the centrifuge. The continuous process is distinguished from a batch process in which a batch of liquid and solid material is fed into the centrifuge. After the materials are separated, the centrifuge is stopped and the separated materials are removed before another batch is loaded into the centrifuge. Both the continuous and batch separation processes are also considered to dry the solid material. The separation process is used in a wide range of applications including the production of soap powders, coal, gypsum, plastic granules, potash, salt, food products, and dairy products.

Industrial centrifuges may be classified according to how they separate the liquid and solid materials. In screen centrifuges, the centrifugal acceleration causes the liquid to pass through a screen through which the larger solid material cannot pass. In decanter centrifuges, there is no screen to physically separate the liquid and solid materials. Instead, the liquid and solid materials are separated by the centrifugal acceleration. The clearing of the liquid typically takes place in the cylindrical portion of the bowl of a decanter centrifuge, whereas the dewatering of the solids via filtration or compression occurs in the conical portion of the bowl.

The inside of a bowl of a centrifuge must be cleaned occasionally prior to start up or after use in order to remove materials which have accumulated along the bowl wall and have not been discharged. Preferably, this clean up is performed without disassembly of the centrifuge. Centrifuges have been cleaned using various methods, such as those disclosed in U.S. Pat. Nos. 4,036,426, 4,978,331, and 5,397,471.

Decanter centrifuges used in the food processing industry require special machinery for processing food and dairy products. For example, machinery used in processing dairy products should not have metal to metal contacts exposed to the dairy products. All areas of the machine that are exposed to the dairy products, including seals, should be washable. There should be no places where product can collect and allow bacteria to grow.

SUMMARY OF THE INVENTION

To address the special requirements for centrifuges used in the food processing industry, the present invention provides for a clean-in-place decanter centrifuge. The invention is especially suited for use in the dairy industry in separating lactose (milk sugar) solids from whey.

The present invention relates to a decanter centrifuge for processing a combined liquid and solid material to separate the liquid from the solid material, the centrifuge comprising:

a drive housing having an exterior wall and an interior surface bounding a contained volume within the housing and means to drive the centrifuge, said exterior wall including an end wall;

a discharge housing mounted to the drive housing, said discharge housing having an exterior wall including a front wall, a peripheral wall disposed between the front wall and the exterior wall of the drive housing, and an interior surface bounding a contained volume within the housing;

a bowl and scroll assembly mounted in the discharge housing to rotate about an axis of rotation, said bowl and scroll assembly having an outer wall cooperating with the peripheral wall to form an enclosure therebetween, said enclosure receiving liquid that is separated from the solid material, the peripheral wall of said discharge housing cooperating with the end wall of said drive housing to form a cavity therebetween;

a first non-contacting seal means for separating said enclosure from said cavity, thereby inhibiting a flow of liquid between said enclosure and said cavity;

a second non-contacting seal means for separating said cavity from the contained volume within the drive housing, thereby inhibiting a flow of fluid between said contained volume and said cavity; and means connected to the discharge housing for injecting a fluid into the first non-contacting seal means between said discharge housing and said bowl and scroll assembly for cleaning said non-contacting seal means;

wherein there are no metal-to-metal contact areas within the interior of the bowl and scroll assembly.

In one embodiment, the outer wall of the bowl and scroll assembly comprises a plurality of drain lines located in the rear wall section of the bowl to allow essentially all liquid to drain from the bowl and scroll assembly.

In another embodiment, the bowl hub comprises at least one drain line to allow lubrication oil to drain into said cavity and prevent ingress of lubrication oil into said bowl and scroll assembly.

In yet another embodiment, the discharge housing further comprises an enclosure bound by the interior surface of the exterior wall of the discharge housing, partitions within the discharge housing, and the outer wall of the rotating bowl, said partitions being separated from the outer wall of the rotating bowl by non-contacting seals whereby fine solid material that migrates into said enclosure is removable from the discharge housing by liquid sprayed from one or more fluid injectors inserted into said enclosure.

DETAILED DESCRIPTION OF THE INVENTION

Figure 1:
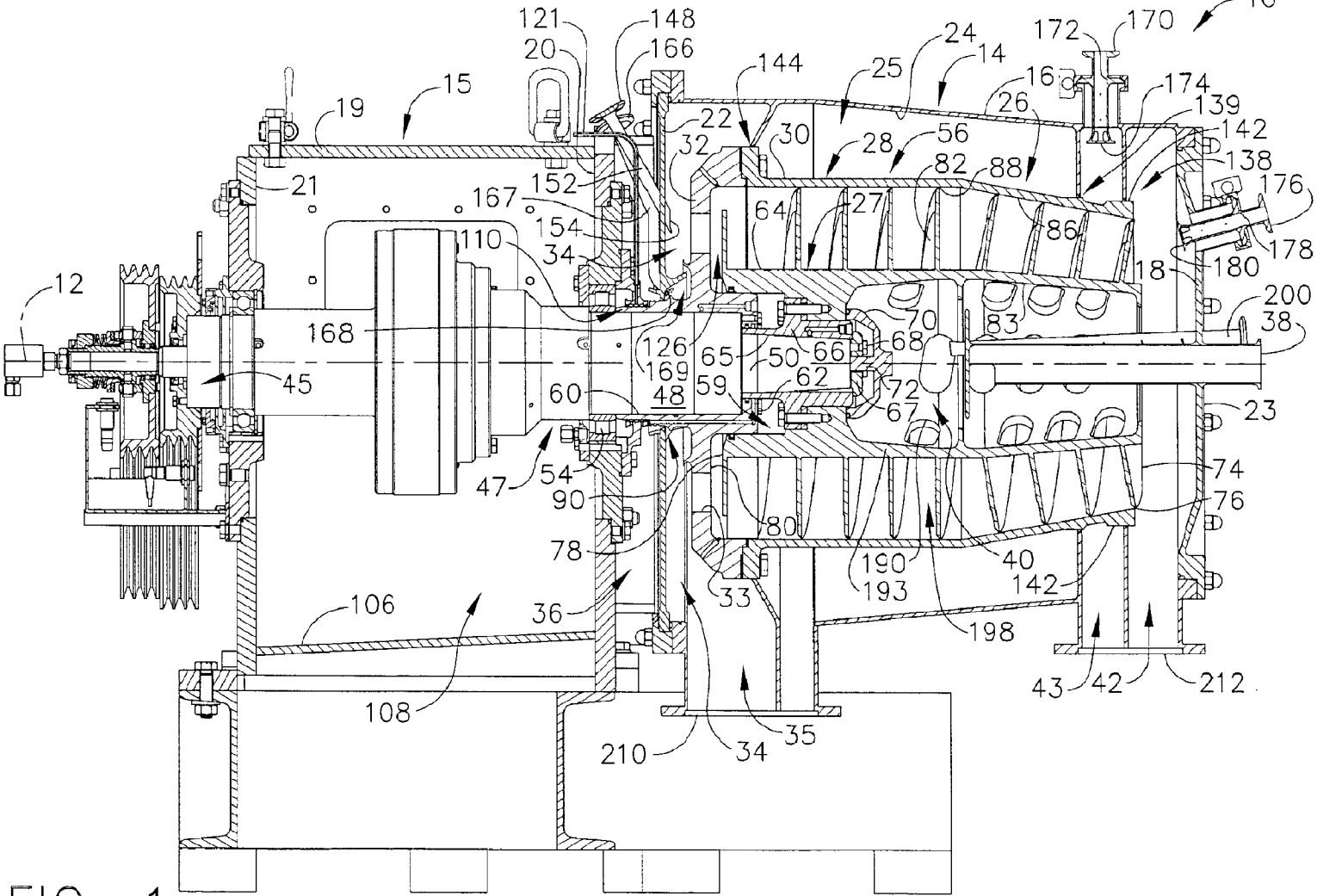
FIG. 1 is a partial cut-away sectional view of a decanter centrifuge of the present invention.

In general terms, the operation of a decanter centrifuge of the invention can be described as follows. The main rotating assembly in the decanter centrifuge is a solid bowl with a cylindrical/conical configuration that is supported at one end only (overhung design). Within the bowl there is a scroll assembly supported by bearings between itself and the bowl. By using some type of driver, such as an electric or hydraulic motor, the bowl and scroll assembly usually rotate in the same direction but with a difference in speed that is governed by a gear reducer. The scroll assembly rotates either slightly faster or slower depending on the application and how it is mechanically set-up. The rotational speed of the bowl determines the gravitational force developed based on the bowl's largest diameter. Such a decanter centrifuge can be used when the feed slurry is comprised of liquid and solid phases that are required to be separated and the solid phase is either too small or too light to settle on its own. The added effect of increased gravitational force helps to accelerate the settling rate of the solids from the liquids.

The feed slurry is introduced into the feed zone of the rotating scroll via a feed tube. The feed slurry passes through the rotating scroll and begins to collect inside the rotating cylindrical section of the bowl. Due to the centrifugal forces exerted by the rotating bowl, the solids settle through the liquid phase and collect and compress against the inside of the bowl wall. The liquid phase forms a pool within the rotating bowl and eventually reaches a pre-determined height and begins to decant out of the rotating bowl. This clarified liquid phase exits the decanter via a liquid discharge chute. Simultaneously, the collecting solids are transported along the cylindrical section of the bowl until they reach the conical section. As the solids are transported up the conical section, the solids eventually reach a level where they are no longer submerged in the liquid pool. In this area of the bowl, the separated solids are dewatered as they tumble in front of the rotating scroll flights and continue to be transported to the solids discharge chute. At this point, the dewatered solids leave the rotating bowl assembly and are discharged through a solids discharge chute. The decanter centrifuge is capable of receiving a continuous feed and separating, dewatering, transporting and discharging the separated solid and liquid materials at full process speed. If the physical and chemical properties of the feed slurry are held constant, a properly sized decanter can process large volumes of material over extended periods of time with little, if any, variation in separation quality.

In the centrifuge of the invention, all surfaces in contact with the material being processed may be cleaned-in-place, and all such surfaces are oriented vertically downward such that they drain freely. The construction of the centrifuge eliminates all metal-to-metal contact or joints between metallic surfaces in contact with the material being processed. Therefore, the invention has an advantage of providing a clean-in-place decanter centrifuge that may be used for processing a wide range of products in the food and dairy industries.

Figure 9:
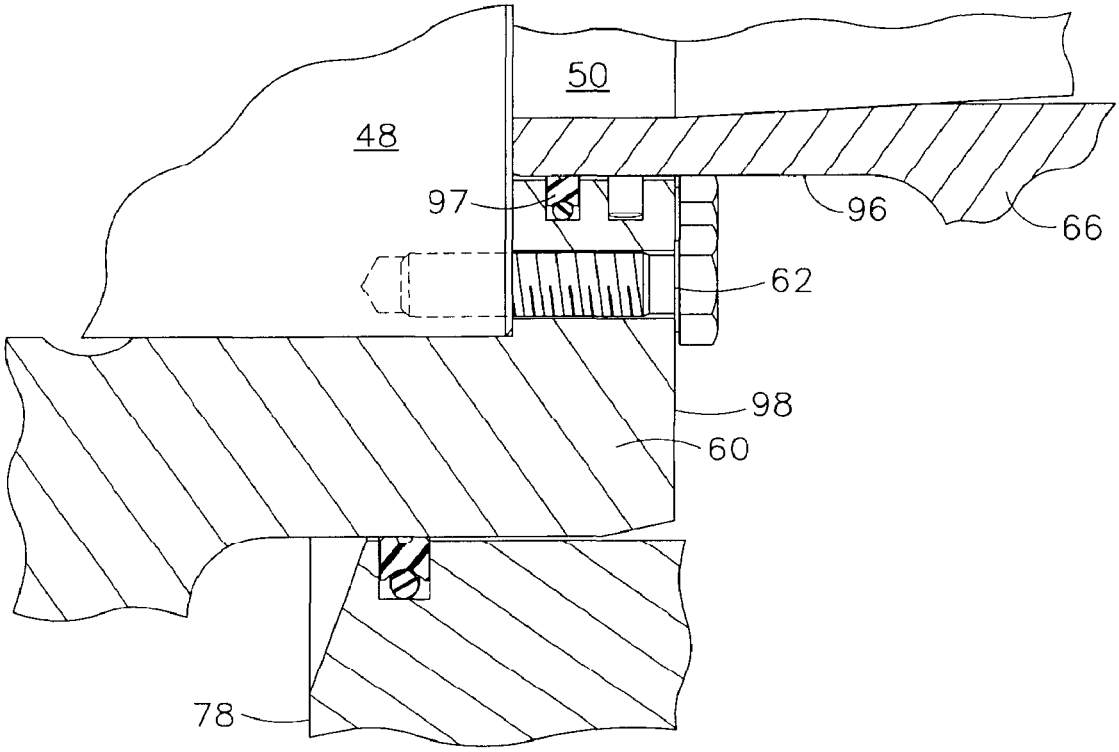
FIG. 9 is an enlarged sectional view of a portion of the connections between the hub of the bowl and the hub of the scroll assembly of the centrifuge of FIG. 1.
Figure 10:
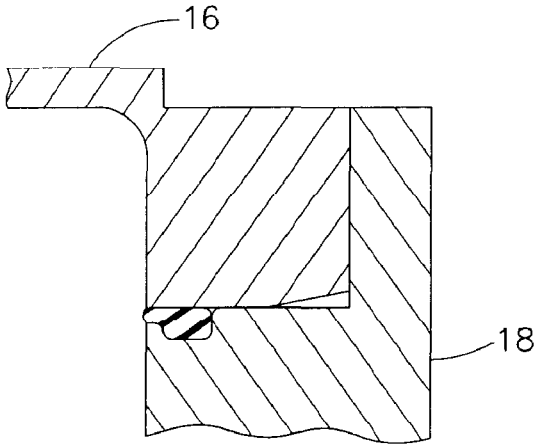
FIG. 10 is an enlarged sectional view of the connection between the front wall and the exterior wall at the front of the discharge housing of the centrifuge of FIG. 1.

FIGS. 1-13 are views illustrating one embodiment of the invention, a continuous decanter centrifuge 10. Centrifuge 10 is a horizontal machine in that the rotating components turn about a horizontal axis of rotation 12. The centrifuge is comprised of a discharge housing 14 that is mounted to a drive housing 15. The discharge housing 14 has an exterior wall 16 which includes a front wall 18 and a peripheral wall 22 located between the front wall 18 and an end wall 20 of the drive housing 15. As shown in FIG. 6, the peripheral wall 22 is connected to the exterior wall 16 through a contacting and clean-in place seal. As shown in FIG. 10, the front wall 18 is connected to the exterior wall 16 through a contacting and clean-in-place seal. The front wall 18 of the discharge housing 14 includes a cover 23 which permits access to the interior of the centrifuge. Further, the exterior wall 16 has an interior surface 24 bounding the contained volume of the discharge housing 14. The drive housing 15 has an exterior wall 19 which includes the end wall 20 proximal to the discharge housing and a front wall 21 distal to the discharge housing. The exterior wall 19 has an interior surface 106 bounding the contained volume of chamber 108 of drive housing 15.

A bowl and scroll assembly 26 comprising a bowl 56 and a scroll assembly 27 is rotatably mounted within the discharge housing 14. The bowl 56 has an outer wall 28 comprised of a circumferential wall section 30 and a rear wall section 32. The rear wall section 32 of the bowl 56 cooperates with the interior surface 24 of the peripheral wall 22 of the discharge housing 14 to form an enclosure 34 therebetween. The end wall 20 of the drive housing 15 cooperates with the peripheral wall 22 of the discharge housing 14 to form a cavity 36 therebetween. The combined liquid and solid material is fed into the centrifuge 10 through a feed tube 38 to a feed zone 40 of the scroll assembly 27. Rotation of the bowl and scroll assembly 26 results in liquid being discharged through a plurality of openings 33 in the rear wall section 32 of the bowl 56 (for example, eight openings equally spaced around the circumference of the rear wall section of the bowl) into the enclosure 34 where it falls into liquid discharge chute 35 of discharge housing 14 and is discharged from the centrifuge. The solid material is discharged from the front end of the bowl 56 and the scroll assembly 27 into the solids discharge chute 42 of the discharge housing 14.

The centrifuge is powered by a motor 44 (see FIG. 2) which is mechanically coupled by V-belts (not shown) extending between a rotating output shaft (not shown) to an input shaft 45 of a multiple shaft drive 47. The input shaft is connected to internal gearing which produces a first rotary drive by driving the outer drive shaft 48 at a first angular velocity, for example, 1950 rpm. The multiple shaft drive 47 provides a second rotary drive via internal gearing to drive the inner drive shaft 50 at a second velocity, for example, 1970 rpm, which is greater than the first velocity by a predetermined factor. The inner drive shaft 50 is rotatably mounted within the outer drive shaft 48, and the outer and inner drive shafts 48, 50 are concentrically located about the axis of rotation 12. The inner drive shaft 50 is coupled to the outer drive shaft 48 by bearings (not shown), and the outer drive shaft 48 is rotatably coupled to a drive housing 15 by bearings 54. Consequently, the motor 44 and multiple shaft drive 47 are effective to provide independent rotary drives that have different angular velocities.

Figure 8:
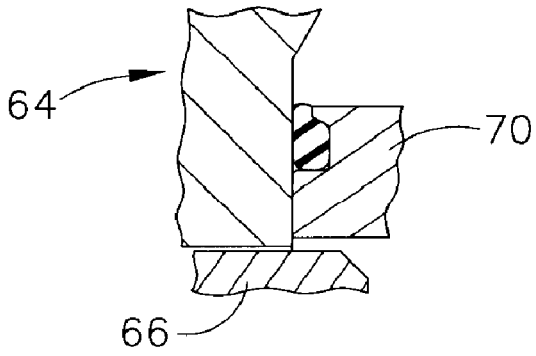
FIG. 8 is an enlarged sectional view of the connection between the scroll member, the hub of the scroll member, and the cap of the inner drive shaft of the centrifuge of FIG. 1.

The bowl and scroll assembly 26 comprises a bowl 56 having an integral hub 60 which is centrally located in the rear wall section 32 of the bowl 56 and is mechanically connected to the outer drive shaft 48 by bolts 62. Therefore, the bowl 56 is mounted within the discharge housing 14 to rotate about the axis of rotation 12. A scroll member 64 has a hub 66 which is centrally located within the bore 65 of the scroll member 64 and is mechanically connected to the inner drive 50 by a key (not shown) and retained by bolts 68. A cap 70 having an integral threaded stud 72 is removably connected to the inner drive shaft 50 thereby permitting access to the bolts 68 which secure retaining plate 67 to the inner drive shaft 50. As shown in FIG. 8, the scroll member 64 is connected to the cap 70 through a contacting clean-in-place seal. FIG. 9 shows a portion of the connections between the hub 60 of the bowl 56 and the hub 66 of the scroll member 64. The hub 66 of the scroll member 64 has a annular recess 96 concentrically located about the axis of rotation 12 and the hub 60 of the bowl 56 has a annular flange 98 concentrically located about the axis of rotation 12 extending into annular recess 96 of the scroll member 64. A contacting seal 97 is located between the annular flange 98 and the annular recess 96. The scroll member 64 has an open front end 74 adjacent an open end 76 of the bowl 56. Similarly, the scroll member 64 has a tubular side wall 83 and a rear end wall 78 closing one end of the tubular side wall 83 adjacent a closed end 80 of the bowl 56.

Figure 7:
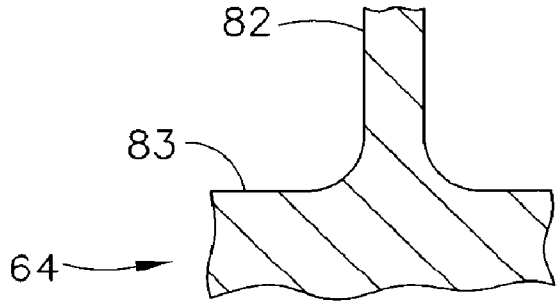
FIG. 7 is an enlarged sectional view of the weld joints between the screw flights and the scroll member of the bowl of the centrifuge of FIG. 1.

Screw flights 82 extend outwardly from a tubular side wall 83 of scroll member 64, and the screw flights extend helically relative to the axis of rotation 12 between the front and rear ends, 74, 78, respectively, of the scroll member 64. As shown in FIG. 7, the screw flights 82 are welded to the tubular side wall 83 of the scroll member 64. The rear end wall 78 extends outwardly from the tubular side wall 83 and connects with one end of the screw flights 82. Each of the screw flights 82 has a peripheral edge 88 which, upon rotation of the scroll member, moves in close proximity to and relative to the inner surface 86 of the bowl 56. There is a clearance of approximately 0.5 mm to 0.8 mm between the outer edges 88 of the screw flights 82 and the inner surface 86 of the bowl 56.

Figure 12:
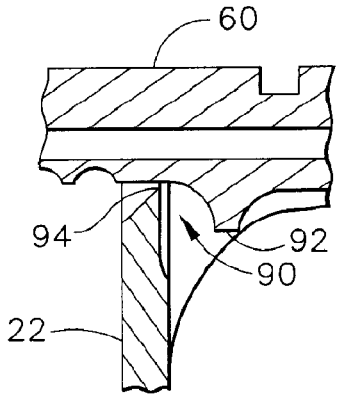
FIG. 12 is an enlarged sectional view of the non-contacting seal between the peripheral wall of the discharge housing and the integral hub of the bowl of the centrifuge of FIG. 1.

For application in the food processing industry, the materials being processed should be contained within the machine and not exposed to foreign material. The majority of the liquid being separated passes through the openings 33 in the rear wall section 32 of the bowl 56. Therefore, the centrifuge contains a first non-contacting seal 90 for separating the enclosure 34 from the cavity 36 and inhibiting the flow of liquid therebetween. As shown in FIG. 12, the first non-contacting seal 90 comprises a machined lip extension 92 from integral hub 60 and a machined tip 94 of peripheral wall 22, which is machined to provide minimum clearance between the peripheral wall 22 and the integral hub 60.

Figure 11:
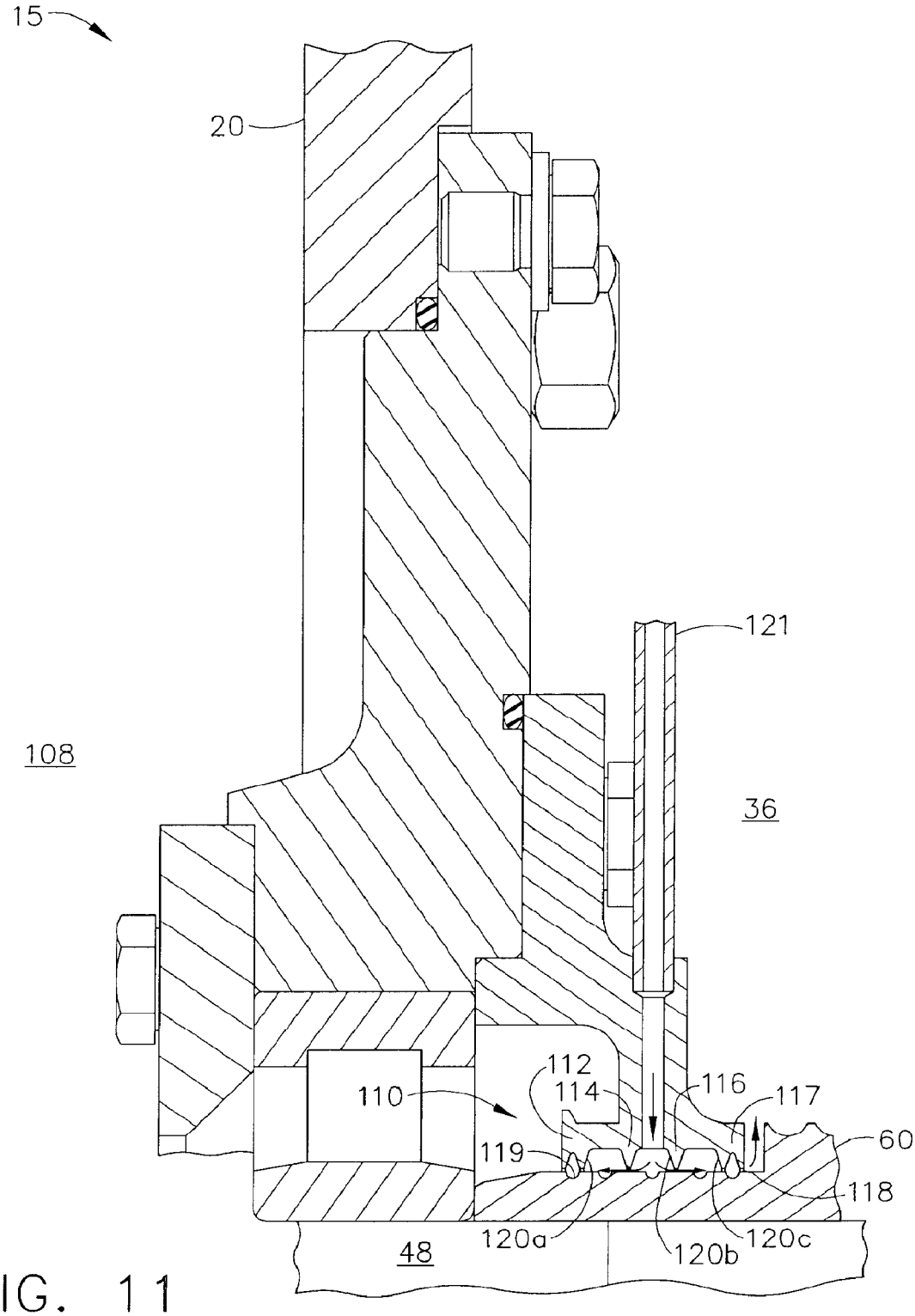
FIG. 11 is an enlarged sectional view of the labyrinth seal between the drive housing and the discharge housing of the centrifuge of FIG. 1.

It is also desirable to isolate the cavity 36 from the chamber 108 in which the drive mechanics and a lubricant are located. The lubricant in the chamber 108 may slip past bearings 54 and into the cavity 36. Therefore, a second non-contacting seal 110 is provided to isolate cavity 36 from chamber 108. As shown in FIG. 11, the second non-contacting seal 110 comprises stationary, generally vertical, rings 112, 114, 116 and 117 which are connected to the back wall 20 of drive housing 15 and are concentrically located about and directed toward the axis of rotation 12. The rings are contiguous with a rotating cylindrical sealing surface 118 on the hub 60 of the bowl 56. The cylindrical sealing surface 118 has grooves 119 which interrupt the migration of lubricant from the chamber 108 along the surface 118. The rotation of the bowl 56 causes the lubricant or process liquid to be thrown off the outer edges of the grooves 119 into the labyrinth cavities **120*a* and 120*c*. Referring to FIG. 11, gravity pulls the lubricant to the bottom surface of the labyrinth cavity 120*a* through the drain holes (not shown) which carry the lubricant back to the chamber 108. Also, gravity pulls process liquid or clean-in-place liquid to the bottom surface of the labyrinth cavity 120*c* through drain holes (not shown) which carry the liquid back to the cavity 36. The center labyrinth cavity 120*b* allows a flow of air via pipe 121 to pressurize the seal and separate the outer labyrinth cavities 120*a* and 120*c***.

Figure 3:
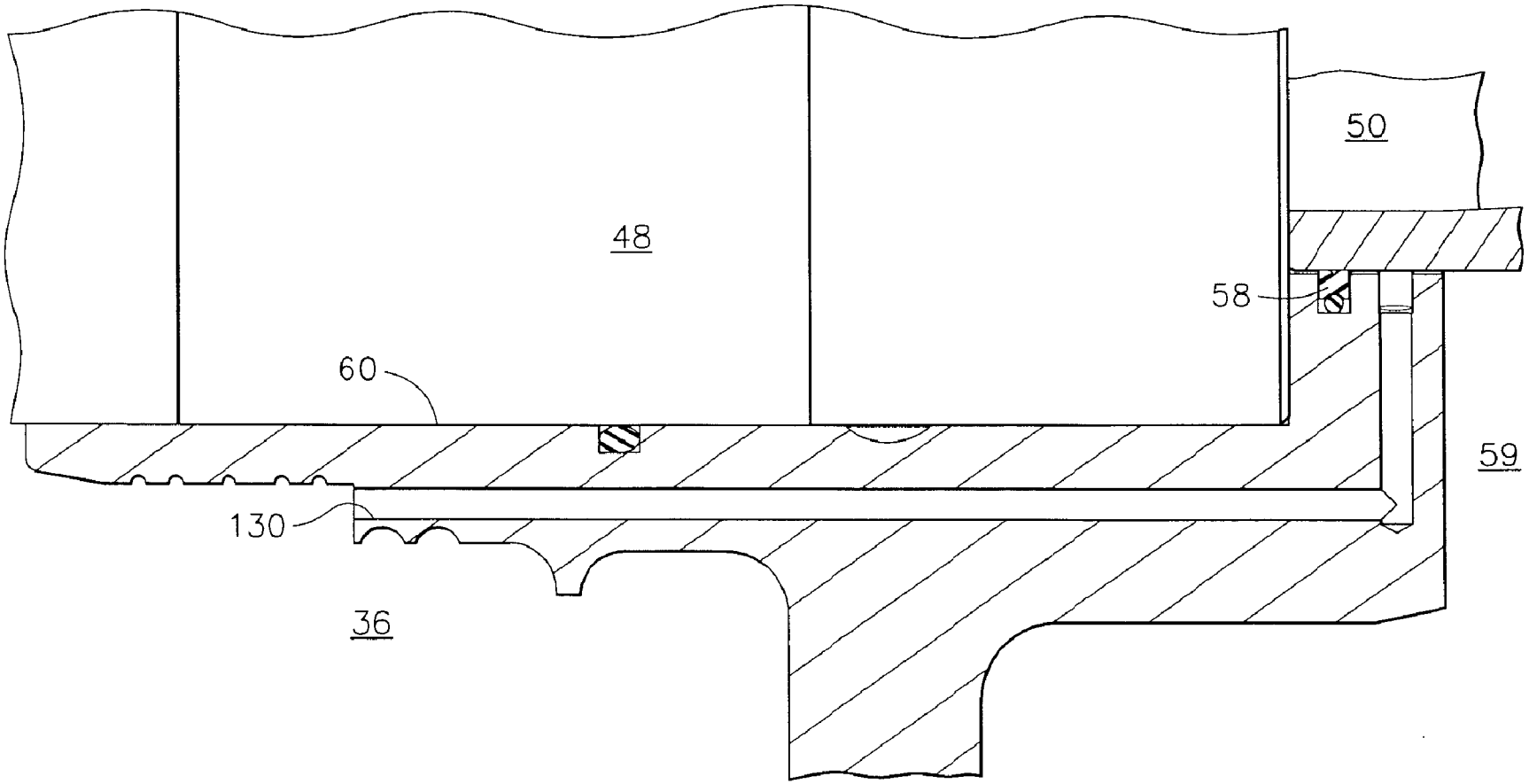
FIG. 3 is an enlarged sectional view of the drain line in the bowl hub of the centrifuge of FIG. 1.

Referring to FIGS. 1 and 3, if leakage occurs through the shafting and passes by the seal 58 into the area 59 between the hub 60 of thee bowl 56 and the hub 66 of the scroll member 64, a drain line 130 has been included in the bowl hub 60 to direct fluid out from the area 59 into cavity 36. Thus, the bowl hub 60 comprises at least one drain line 130 to allow lubrication oil to drain into the cavity 36 and prevent ingress of lubrication oil into the bowl and scroll assembly 26. The presence of lubrication oil in cavity 36 indicates a failure has occurred in the existing seal arrangements. The failed seal should be repaired or replaced to prevent possible ingress of lubrication oil into the bowl and scroll assembly 26 of centrifuge 10.

Figure 13:
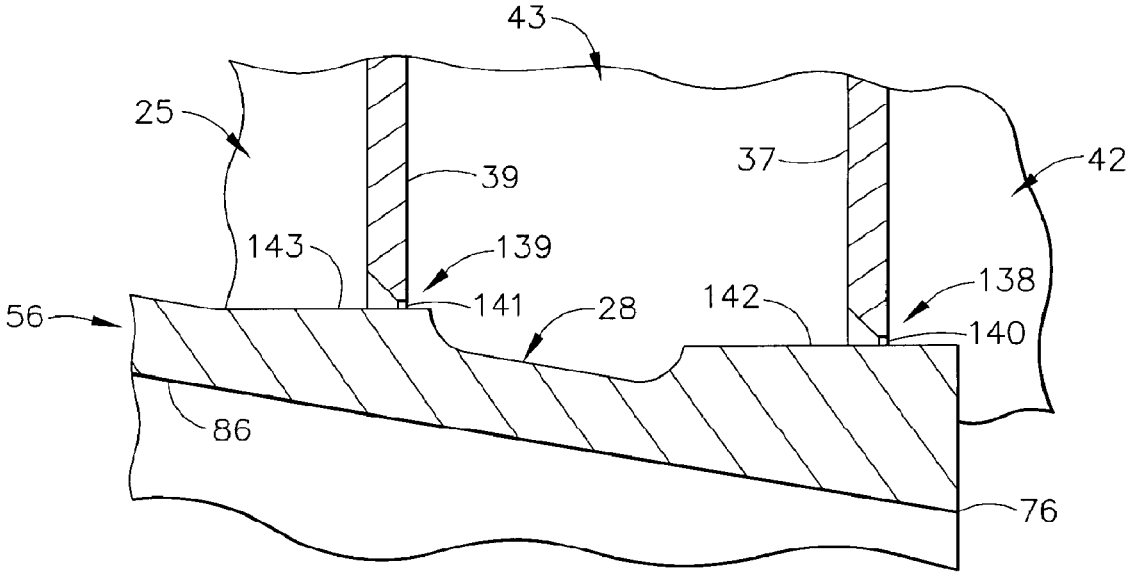
FIG. 13 is an enlarged sectional view of the non-contacting seals between the discharge housing and the rotating bowl near the front of the centrifuge of FIG. 1.

Referring to FIG. 13, a third non-contacting seal 138 and a fourth non-contacting seal 139 are located between the discharge housing 14 and the bowl 56 close to the front wall 18 of the discharge housing 14. The third non-contacting seal 138 is comprised of a stationary, cylindrical, housing sealing surface 140 which is directed toward and located concentrically about the axis of rotation 12. The outer wall 28 of the rotating bowl 56 has a mating, rotating cylindrical surface 142 adjacent the open front end 76 of the bowl 56. A fourth non-contacting seal 139 is comprised of a stationary, cylindrical, housing sealing surface 141 which is directed toward and located concentrically about the axis of rotation 12. The outer wall 28 of the rotating bowl 56 has a mating, rotating cylindrical surface 143 near the open front end 76 of the bowl 56. The enclosure 43 is bound by partitions 37 and 39 within the discharge housing 14, the interior surface 24 of the exterior wall 16 of the discharge housing 14, and the outer wall 28 of the rotating bowl 56. The partitions 37 and 39 are separated from the outer wall 28 of the rotating bowl 56 by the third non-contacting seal 138 and the fourth non-contacting seal 139. Fine solid material that migrates into the enclosure 43 is flushed from the discharge housing 14 by liquid sprayed from one or more fluid injectors, such as fluid injectors 170 shown in FIGS. 1-2, inserted into the enclosure 43.

Figure 4:
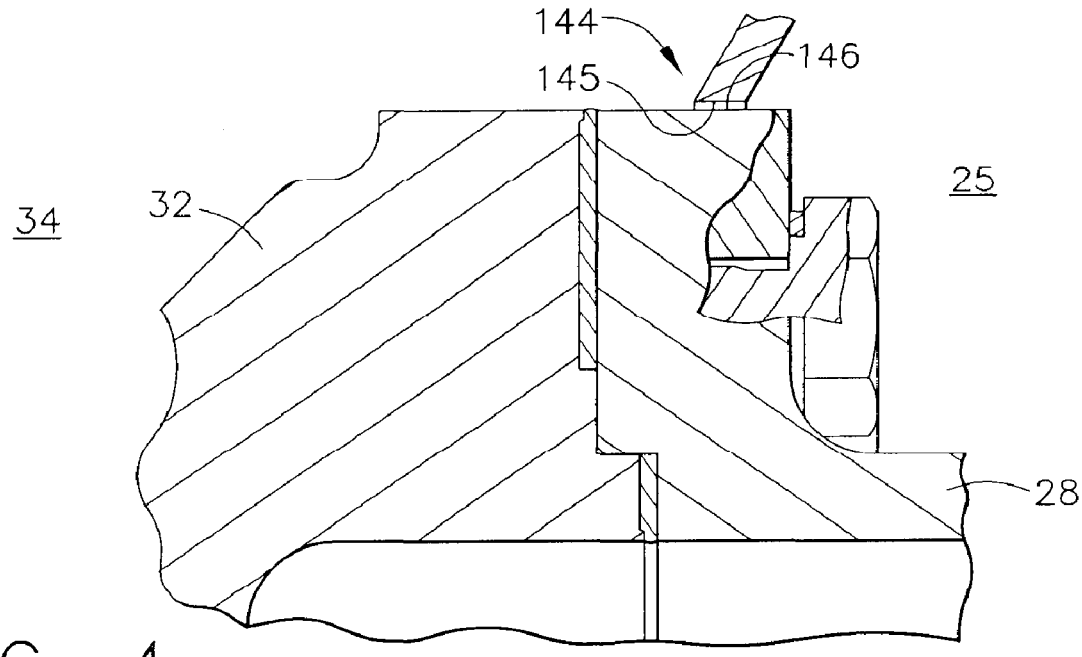
FIG. 4 is an enlarged sectional view of the seals at the back of the bowl of the centrifuge of FIG. 1.

As shown in FIG. 4, a fifth non-contacting seal 144 is located between the discharge housing 14 and the rotating bowl 56 close to the machined outer diameter of the bowl 56 where the outer wall 28 connects to the rear wall section 32 through contacting and clean-in-place seals. The fifth housing seal 144 is comprised of a stationary, cylindrical housing sealing surface 145 which is directed toward and located concentrically about the axis of rotation 12. The outer wall 28 of bowl 56 has a mating rotating cylindrical surface 146 adjacent to rear wall section 32 of the housing 14 to inhibit the flow of liquid from enclosure 34 to enclosure 25.

It is necessary that the centrifuge 10, when used for processing food materials, be able to be cleaned in place. Preferably, that cleaning should be implemented without requiring the disassembly of components of the centrifuge 10. Therefore, the present invention has the additional advantage of having self-cleaning components. Referring to FIG. 1, a first fluid injector 166 is located in the discharge housing 14 near the first non-contacting seal 90. The first fluid injector 166 is connected to an external fluid source (not shown) by fluid lines (not shown). Fluid injector 166 releases liquid via passage 167 and opening 168 into space 169 and out enclosure 34. Wash liquid introduced into space 169 and enclosure 34 removes any remaining or adhering process liquid in proximity of sealing components 92 and 94 of the first non-contacting seal 90. Wash liquid is released from housing 14 via liquid discharge chute 35.

The rear wall section 32 of the bowl 56 contains a plurality of openings 33 providing access to the space 126 bounded by the closed end 80 of the bowl 56 and the rear end 78 of the scroll member 64. A fluid injector 148 also provides wash liquid via passage 152 and opening 154 and into the space 126 for washing the surfaces bounding the space 126. This wash liquid enters into space 126 by passing through openings 33 in the bowl 56 and contacts the rear end wall 78 of scroll member 64. The wash liquid in space 126 is released through a plurality of drain ports 57 in the bowl 56 and is discharged via liquid discharge chute 35.

Figure 2:
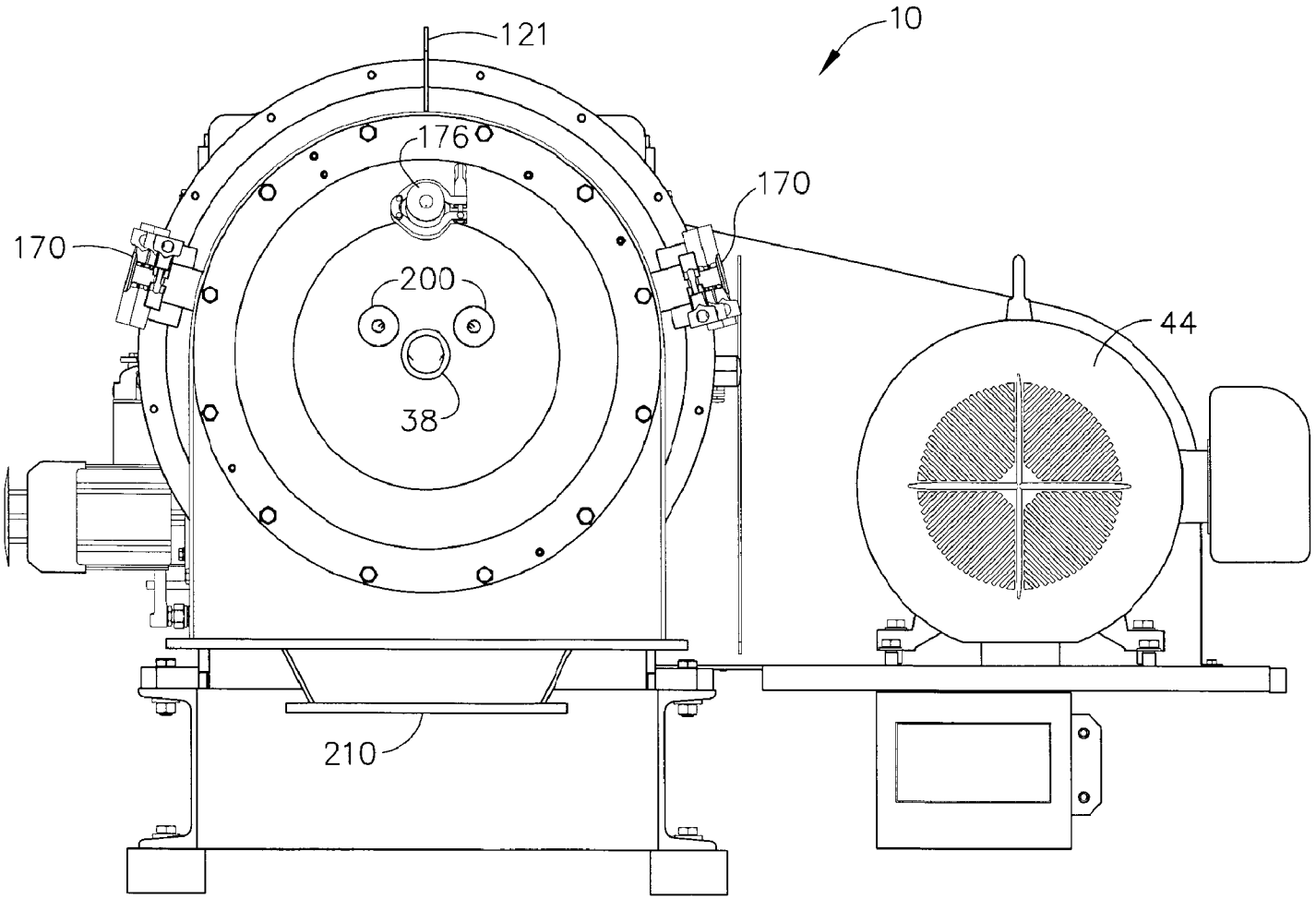
FIG. 2 is a front view of the centrifuge of FIG. 1.

Referring to FIGS. 1-2, fluid injectors 170 are located in the discharge housing 14 between the third non-contacting seal 138 and the fourth non-contacting seal 139. The fluid injectors 170 are connected to an external fluid source (not shown) by fluid lines (not shown). Fluid injectors 170 release liquid via passages 172 and openings 174 into enclosure 43. Wash liquid introduced into enclosure 43 removes any remaining or adhering process liquid in proximity of non-contacting sealing components 138 and 139. Wash liquid is released from discharge housing 14 via enclosure 43 and out discharge chute 212.

A fluid injector 176 is connected to the fluid source (not shown) and by fluid lines (not shown) has an internal passage 178 terminating with a fluid nozzle 180 which is effective to spray cleaning fluid on the internal surfaces of the front side of the centrifuge 10. The third non-contacting seal 138 is at the dry end of the centrifuge; and therefore, with its construction, it should accumulate little or no liquid or solid material between its mating surfaces 140, 142. However, during the cleaning process the fluid sprays from the nozzles 174, 180 are effective to circulate cleaning fluid between the surfaces 140, 142 of the third non-contacting seal 138.

Referring to FIGS. 1-2, a fluid injector 200 is connected to the fluid source by fluid lines and has a fluid passage (not shown) terminating at a spray nozzle (not shown). The fluid injector 200 is effective to spray cleaning fluid on the internal surfaces of the rotating scroll member 64. The tubular side wall 83 of the scroll member 64 has three circumferential groups of openings at different positions along the axis of rotation 12. Cleaning fluid from the spray nozzle passes through openings 190.

Additional fluid injectors may be connected to the fluid source by fluid lines and extend through the peripheral wall 22, the exterior wall 16 and/or the front wall 18 of the discharge housing 14. Consequently, all of the surfaces of the bowl and scroll assembly 26 and the housing 14 in contact with the liquid and solid material may be cleaned in place without disassembling the centrifuge 10.

Figure 5:
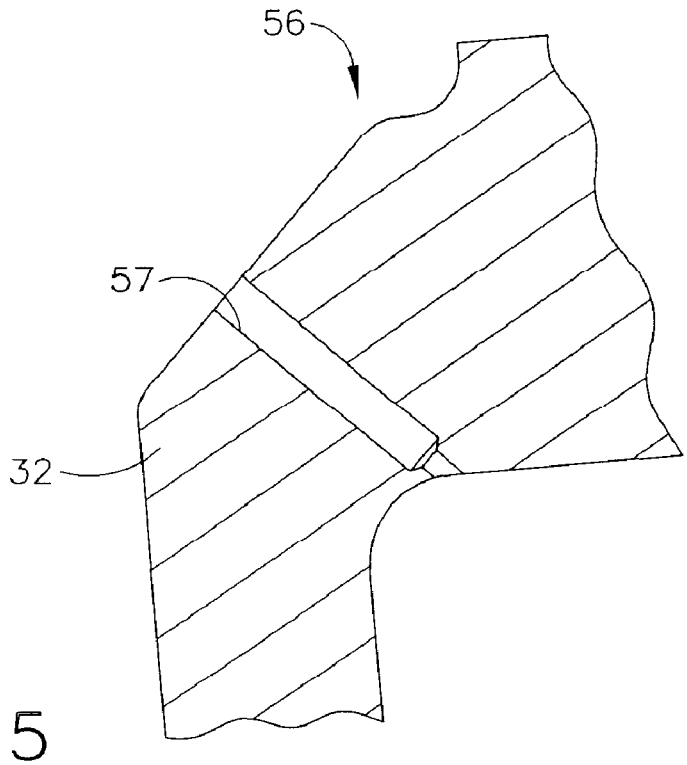
FIG. 5 is an enlarged sectional view of the drain line in the rear wall section of the bowl of the centrifuge of FIG. 1.
Figure 6:
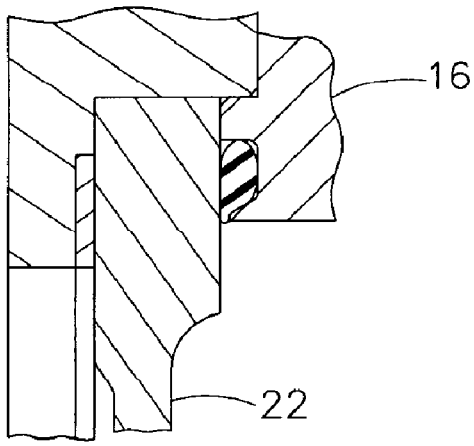
FIG. 6 is an enlarged sectional view of the connection between the peripheral wall and the exterior wall at the back of the discharge housing of the centrifuge of FIG. 1.

As shown in FIG. 5, the rear wall section 32 of the bowl 56 has a plurality of drain ports 57 (for example, two or more ports equally spaced around the circumference of the rear wall section 32) to allow essentially all liquid to drain from the bowl 56 and the scroll assembly 27.

In use, for example in the application of separating lactose (milk sugar) solids from whey, the motor 44 drives the bowl and scroll assembly 26 in a clockwise direction as viewed from the front of the centrifuge, as in FIG. 2. The bowl 56 rotates at, for example, 1950 rpm, and the scroll member 64 rotates at, for example, 1970 rpm. The mother liquor, which is a combination of the whey and lactose solids, is continuously fed into the centrifuge 10 through feed tube 38. The feed tube 38 directs the mother liquor to the central portion 193 of the rotating scroll member 64 into the feed area 40. The central portion 193 of the scroll member 64 contains a group of circumferential openings 190 through which the mother liquor flows into a volume 198 bounded by the rear end 78, the tubular side wall 83 and the screw flights 82 of the scroll member 64, and the inner surface 86 of the bowl 56. The angular velocity of the bowl and scroll assembly 26 creates centrifugal forces which separate the solid and the liquid phases. The solids accumulate on the inner surface 86 of the bowl 56. The liquid level inside the bowl 56 is determined by the location of openings 33 in the rear wall section 32 of the bowl 56.

The angular velocity of the rotating scroll member 64 is faster than the angular velocity of the bowl 56. The difference in angular velocities between the scroll member 64 and the bowl 56 is effective to cause the lactose solid material to move along the leading front edge 88 of the screw flights 82 and across the inner surface 86 of the bowl 56 toward the open end 76 of the bowl 56. Fluid injector 176 has an internal passage 178 connecting spray nozzle 180 to a fluid source (not shown) by a fluid line (not shown). The lactose solid particles may collect on the interior surface and the front wall 18 of the discharge housing 14. Therefore, the fluid injector 176 sprays a sluicing solution such as water onto the lactose solid material moving toward the open end 76 of the bowl 56 to direct the solids down discharge chute 212.

Referring to FIGS. 1-2, centrifugal forces from the rotating bowl 56 drive the liquid centrate into the discharge chute 35. The liquid centrate is moved by the centrifugal forces and turbulence from the rotating bowl and scroll assembly into a collection unit 210. The lactose particles are discharged in a discharge chute 212.

The components of the centrifuge 10 which are in contact with the material being processed are made of 316 L stainless steel. All product contact surfaces are polished to 150 grit finish. The metallic housing, metallic bowl and metallic scroll member are constructed and interconnected such that no metallic surface inside the centrifuge that contacts the liquid and solid material is in metal-to-metal contact with another metallic surface also in contact with the liquid and solid material. As illustrated in the drawings, the centrifuge is further constructed such that all metallic surfaces of the housing, bowl member and scroll member in contact with the liquid and solid material being processed are oriented in a vertically downward direction so that they drain freely.

After a predetermined period of use which may be measured in hours, days or weeks, the input of the mother liquor is stopped, and the machine is cleaned in place without disassembly. The cleaning process may require cleaning the centrifuge with a succession of different fluids such as an acid solution, a caustic solution and water. The fluid source contains or is connected to the sources of the required solutions, and under automatic or manual control the appropriate solutions are fed through the feed lines, through the fluid injectors and into the centrifuge 10. Consequently, the centrifuge of the present invention may be used in applications such as food processing where the clean-in-place capability is required.

While the invention has been set forth by the description of the embodiments in considerable detail, it is not intended to restrict or in any way limit the claims to such detail. Additional advantages and modifications will readily appear to those who are skilled in the art. For example, the multiple shaft drive may be driven at different speeds by independent input shafts connected to multiple pulleys or gears mounted on the output drive shaft of the motor. Further, the bowl and scroll assembly is typically oriented to rotate about a horizontal axis of rotation, however, the bowl and scroll assembly may be constructed to rotate about a vertical axis of rotation.

The invention, in its broadest aspects, is therefore not limited to the specific details shown and described. Accordingly, departures may be made from such details without parting from the spirit or scope of the general inventive concept.

What is claimed is:

1. A decanter centrifuge for processing a combined liquid and solid material to separate the liquid from the solid material, the centrifuge comprising:

a drive housing having an exterior wall and an interior surface bounding a contained volume within the housing and means to drive the centrifuge, said exterior wall including an end wall;

a discharge housing mounted to the drive housing, said discharge housing having an exterior wall including a front wall, a peripheral wall disposed between the front wall and the exterior wall of the drive housing, and an interior surface bounding a contained volume within the housing;

a bowl and scroll assembly mounted in the discharge housing to rotate about an axis of rotation, said bowl and scroll assembly having an outer wall cooperating with the peripheral wall to form an enclosure therebetween, said enclosure receiving liquid that is separated from the solid material, the peripheral wall of said discharge housing cooperating with the end wall of said drive housing to form a cavity therebetween;

a first non-contacting seal means for separating said enclosure from said cavity, thereby inhibiting a flow of liquid between said enclosure and said cavity;

a second non-contacting seal means for separating said cavity from the contained volume within the drive housing, thereby inhibiting a flow of fluid between said contained volume and said cavity; and means connected to the discharge housing for injecting a fluid into the first non-contacting seal means between said discharge housing and said bowl and scroll assembly for cleaning said non-contacting seal means;

wherein there are no metal-to-metal contact areas within the interior of the bowl and scroll assembly, and the outer wall of the bowl and scroll assembly comprises a plurality of drain ports located in the rear wall section of the bowl to allow essentially all liquid to drain from the bowl and scroll assembly.

2. The decanter centrifuge of claim 1 wherein said centrifuge includes a hollow outer rotary drive and an inner rotary drive concentrically rotating within and relative to the outer rotary drive, and said bowl and scroll assembly further comprises a bowl mounted within said housing and connected to the outer rotary drive to rotate about said axis of rotation, said bowl having an open end and a closed end and an inner surface; and a scroll member mounted within said bowl and connected to the inner rotary drive to rotate about said axis of rotation relative to said bowl, said scroll member having a tubular side wall having a front end and a rear end adjacent said open and closed ends, respectively, of said bowl, a helical screw flight extending outward from said tubular side wall and extending between said rear end and said front end of said scroll member, said screw flight having an edge moving in close proximity and relative to said inner surface of said bowl, whereby rotation of said edge of said screw flight of said scroll member sweeps a volume having a shape substantially corresponding to that of the interior of the bowl.

3. The decanter centrifuge of claim 2 wherein said bowl has a centrally located integral hub connected to the outer rotary drive and said scroll member has a centrally located hub connected to said inner drive.

4. The decanter centrifuge of claim 3 wherein said first non-contacting seal means comprises a machined lip extension from the integral hub of the bowl and a machined tip of said peripheral wall.

5. The decanter centrifuge of claim 4 further comprising a contacting sealing means connected between said hub of said bowl and said hub of said scroll member.

6. The decanter centrifuge of claim 5 wherein said hub of said scroll member has a annular recess concentrically located about said axis of rotation and said hub of said bowl has a annular flange concentrically located about said axis of rotation extending into said annular recess of said scroll member and said contacting sealing means is located between said annular flange and said annular recess.

7. The decanter centrifuge of claim 3 wherein said bowl hub comprises at least one drain line to allow lubrication oil to drain into said cavity and prevent ingress of lubrication oil into said bowl and scroll assembly.

8. The decanter centrifuge of claim 1 wherein the discharge housing further comprises an enclosure bound by the interior surface of the exterior wall of the discharge housing, partitions within the discharge housing, and the outer wall of the rotating bowl, said partitions being separated from the outer wall of the rotating bowl by non-contacting seals whereby fine solid material that migrates into said enclosure is removable from the discharge housing by liquid sprayed from one or more fluid injectors inserted into said enclosure.

9. A decanter centrifuge for processing a combined liquid and solid material to separate the liquid from the solid material, the centrifuge comprising:

a drive housing having an exterior wall and an interior surface bounding a contained volume within the housing and means to drive the centrifuge, said exterior wall including an end wall;

a discharge housing mounted to the drive housing, said discharge housing having an exterior wall including a front wall, a peripheral wall disposed between the front wall and the exterior wall of the drive housing, and an interior surface bounding a contained volume within the housing;

a bowl and scroll assembly mounted in the discharge housing to rotate about an axis of rotation, said bowl and scroll assembly having an outer wall cooperating with the peripheral wall to form an enclosure therebetween, said enclosure receiving liquid that is separated from the solid material, the peripheral wall of said discharge housing cooperating with the end wall of said drive housing to form a cavity therebetween;

a first non-contacting seal means for separating said enclosure from said cavity, thereby inhibiting a flow of liquid between said enclosure and said cavity;

a second non-contacting seal means for separating said cavity from the contained volume within the drive housing, thereby inhibiting a flow of fluid between said contained volume and said cavity; and means connected to the discharge housing for injecting a fluid into the first non-contacting seal means between said discharge housing and said bowl and scroll assembly for cleaning said non-contacting seal means;

wherein there are no metal-to-metal contact areas within the interior of the bowl and scroll assembly, and the bowl hub comprises at least one drain line to allow lubrication oil to drain into said cavity and prevent ingress of lubrication oil into said bowl and scroll assembly.

10. The decanter centrifuge of claim 9 wherein said centrifuge includes a hollow outer rotary drive and an inner rotary drive concentrically rotating within and relative to the outer rotary drive, and said bowl and scroll assembly further comprises a bowl mounted within said housing and connected to the outer rotary drive to rotate about said axis of rotation, said bowl having an open end and a closed end and an inner surface; and a scroll member mounted within said bowl and connected to the inner rotary drive to rotate about said axis of rotation relative to said bowl, said scroll member having a tubular side wall having a front end and a rear end adjacent said open and closed ends, respectively, of said bowl, a helical screw flight extending outward from said tubular side wall and extending between said rear end and said front end of said scroll member, said screw flight having an edge moving in close proximity and relative to said inner surface of said bowl, whereby rotation of said edge of said screw flight of said scroll member sweeps a volume having a shape substantially corresponding to that of the interior of the bowl.

11. The decanter centrifuge of claim 10 wherein said bowl has a centrally located integral hub connected to the outer rotary drive and said scroll member has a centrally located hub connected to said inner drive.

12. The decanter centrifuge of claim 11 wherein said first non-contacting seal means comprises a machined lip extension from the integral hub of the bowl and a machined tip of said peripheral wall.

13. The decanter centrifuge of claim 12 wherein said hub of said scroll member has a annular recess concentrically located about said axis of rotation and said hub of said bowl has a annular flange concentrically located about said axis of rotation extending into said annular recess of said scroll member and said contacting sealing means is located between said annular flange and said annular recess.

14. The decanter centrifuge of claim 13 wherein the outer wall of the bowl and scroll assembly comprises a plurality of drain ports located in the rear wall section of the bowl to allow essentially all liquid to drain from the bowl and scroll assembly.

15. The decanter centrifuge of claim 14 wherein the discharge housing further comprises an enclosure bound by the interior surface of the exterior wall of the discharge housing, partitions within the discharge housing, and the outer wall of the rotating bowl, said partitions being separated from the outer wall of the rotating bowl by non-contacting seals whereby fine solid material that migrates into said enclosure is removable from the discharge housing by liquid sprayed from one or more fluid injectors inserted into said enclosure.

16. A decanter centrifuge for processing a combined liquid and solid material to separate the liquid from the solid material, the centrifuge comprising:

a drive housing having an exterior wall and an interior surface bounding a contained volume within the housing and means to drive the centrifuge, said exterior wall including an end wall;

a discharge housing mounted to the drive housing, said discharge housing having an exterior wall including a front wall, a peripheral wall disposed between the front wall and the exterior wall of the drive housing, and an interior surface bounding a contained volume within the housing;

a bowl and scroll assembly mounted in the discharge housing to rotate about an axis of rotation, said bowl and scroll assembly having an outer wall cooperating with the peripheral wall to form an enclosure therebetween, said enclosure receiving liquid that is separated from the solid material, the peripheral wall of said discharge housing cooperating with the end wall of said drive housing to form a cavity therebetween;

a first non-contacting seal means for separating said enclosure from said cavity, thereby inhibiting a flow of liquid between said enclosure and said cavity;

a second non-contacting seal means for separating said cavity from the contained volume within the drive housing, thereby inhibiting a flow of fluid between said contained volume and said cavity; and means connected to the discharge housing for injecting a fluid into the first non-contacting seal means between said discharge housing and said bowl and scroll assembly for cleaning said non-contacting seal means;

wherein there are no metal-to-metal contact areas within the interior of the bowl and scroll assembly, and wherein the discharge housing further comprises an enclosure bound by the interior surface of the exterior wall of the discharge housing, partitions within the discharge housing, and the outer wall of the rotating bowl, said partitions being separated from the outer wall of the rotating bowl by non-contacting seals whereby fine solid material that migrates into said enclosure is removable from the discharge housing by liquid sprayed from one or more fluid injectors inserted into said enclosure.

17. The decanter centrifuge of claim 16 wherein said centrifuge includes a hollow outer rotary drive and an inner rotary drive concentrically rotating within and relative to the outer rotary drive, and said bowl and scroll assembly further comprises a bowl mounted within said housing and connected to the outer rotary drive to rotate about said axis of rotation, said bowl having an open end and a closed end and an inner surface; and a scroll member mounted within said howl and connected to the inner rotary drive to rotate about said axis of rotation relative to said bowl, said scroll member having a tubular side wall having a front end and a rear end adjacent said open and closed ends, respectively, of said bowl, a helical screw flight extending outward from said tubular side wall and extending between said rear end and said front end of said scroll member, said screw flight having an edge moving in close proximity and relative to said inner surface of said bowl, whereby rotation of said edge of said screw flight of said scroll member sweeps a volume having a shape substantially corresponding to that of the interior of the bowl.

18. The decanter centrifuge of claim 17 wherein said bowl has a centrally located integral hub connected to the outer rotary drive and said scroll member has a centrally located hub connected to said inner drive.

19. The decanter centrifuge of claim 18 wherein said first non-contacting seal means comprises a machined lip extension from the integral hub of the bowl and a machined tip of said peripheral wall.

20. The decanter centrifuge of claim 19 wherein said hub of said scroll member has a annular recess concentrically located about said axis of rotation and said hub of said bowl has a annular flange concentrically located about said axis of rotation extending into said annular recess of said scroll member and said contacting sealing means is located between said annular flange and said annular recess.

21. The decanter centrifuge of claim 20 wherein the outer wall of the bowl and scroll assembly comprises a plurality of drain ports located in the rear wall section of the bowl to allow essentially all liquid to drain from the bowl and scroll assembly.

22. The decanter centrifuge of claim 21 wherein the bowl hub comprises at least one drain line to allow lubrication oil to drain into said cavity and prevent ingress of lubrication oil into said bowl and scroll assembly.

* * * * *